United States Patent [19]

Wyse

[11] Patent Number: 4,798,043

[45] Date of Patent: Jan. 17, 1989

[54] MECHANICAL HACKAMORE

[76] Inventor: Patrick E. Wyse, P.O. Box 695, Conrad, Mont. 59425

[21] Appl. No.: 88,136

[22] Filed: Aug. 21, 1987

[51] Int. Cl.[4] ..... B68B 1/04

[52] U.S. Cl. ..... 54/6 R

[58] Field of Search ..... 54/6 R, 6 A, 7, 24

[56] References Cited

U.S. PATENT DOCUMENTS

| | | | |
|---|---|---|---|
| 30,510 | 4/1860 | Tracy . | |
| 475,110 | 9/1892 | Helms . | |
| 496,222 | 7/1893 | Gilbert . | |
| 725,626 | 4/1903 | Noble . | |
| 1,076,442 | 12/1913 | Niemann . | |
| 1,653,382 | 2/1927 | Wiesenfeld . | |
| 2,025,469 | 12/1935 | Miller | 54/6 R |
| 2,347,752 | 1/1944 | Schmelz | 54/6 R |
| 2,463,279 | 3/1949 | Jones | 54/6 R |
| 2,597,736 | 5/1952 | Jones | 54/6 R |
| 3,318,069 | 11/1967 | Cunard | 54/6 R |
| 3,458,971 | 11/1969 | Stern et al. | 54/6 R |
| 4,132,054 | 9/1979 | Mader | 54/6 R |

FOREIGN PATENT DOCUMENTS

| | | | |
|---|---|---|---|
| 24355 | 5/1906 | Austria | 54/6 R |
| 327940 | 7/1903 | France | 54/6 R |
| 10698 | of 1898 | United Kingdom | 54/6 R |
| 458930 | 6/1951 | United Kingdom . | |

*Primary Examiner*—Robert P. Swiatek

*Attorney, Agent, or Firm*—Wells, St. John & Roberts

[57] ABSTRACT

A mechanical hackamore is described which includes a loop formed by a nose band and stabilizer chin strap to be received over the muzzle of an animal such as a horse. Pivots on opposite sides of the loop mount a pair of leverage frame members. A curb strap is attached across rearward ends of the leverage frame members. Reins and a forward stabilizer bar are situated at forwards ends of the leverage frame members. Leverage action may be applied through the geometry of this arrangement for stopping forces. Each frame member is constructed to span a relatively large surface area of the cheek. Turning forces may be applied through the frame members in such a manner that a turning pull on a rein along one side of the animal's head will result in pressure applied against the muzzle to influence turning of the head in the desired direction.

10 Claims, 3 Drawing Sheets

10
11
12
13
14
15
16
17
18
19
23
24
24a
24b
25
30
31
35
41
50
54
56
64
68

A
B
C
11
13
14
15
16
23
24
25
30
31
35
40
41
46
50
51
52
53
54
56
64
68
70

MECHANICAL HACKAMORE

TECHNICAL FIELD

The present invention relates to bitless bridles in general and more particularly to an improved mechanical hackamore.

BACKGROUND OF THE INVENTION

The standard mechanical hackamore has been in use many years for controlling horses. The typical mechanical hackamore includes a nose band and a chin strap that are interconnected by elongated lever arms on opposite sides of the muzzle adjacent the cheeks. Each end of the nose band is connected to one pivot point on an elongated lever. Similarly, each end of the chin or curb strap is connected to a lever arm at an end usually spaced closely adjacent to the nose band connection. Reins are connected to the opposite end of the cheeks. When the rein is pulled, the lever arms act to bind or pinch the muzzle. This action functions very well to promote stopping of the animal, but has serious disadvantages for turning.

The fact that there is no bit involved renders the two levers relatively independent, so turning forces applied to one causes a resulting binding or gouging effect on the same surface of the horse's cheek. There is a natural tendency for a horse to turn its head away from pain. Thus, the tendency for a standard mechanical hackamore, once turning forces are applied by a rein, is for the horse to turn its head in a direction opposite to the intended direction of the turn. This confuses the horse and inhibits its performance. The leverage factors of the hackamore cheeks allow the rider to stop the horse, but, as indicated above, the levers do not facilitate quick turning. With more precision and speed involved in a maneuver, the more apparent this deficiency becomes.

In training and speed events (roping, barrel racing, etc.) it is humane and practical to avoid putting a bit in the horse's mouth, yet it is desirable to have adequate leverage to stimulate the animal to stop. At the same time, difficulty in turning a horse with a standard mechanical hackamore has always been a limitation and a severe disadvantage.

It is therefore a primary object of the present invention to provide a hackamore that retains adequate leverage for stopping while providing a practical and humane means for the rider to easily turn the horse.

BRIEF DESCRIPTION OF THE DRAWINGS

A preferred embodiment of the invention is exemplified by the accompanying drawings, in which.

DETAILED DESCRIPTION OF THE PREFERRED EMBODIMENT

The following disclosure of the invention is submitted in compliance with the constitutional purpose of the Patent Laws "to promote the progress of science and useful arts" (Article 1, Section 8).

It should be understood initially that the present invention may be utilized with nearly any animal having an elongated muzzle or snout. However, it is preferable that the present invention be utilized for controlling and training of horses. The following exemplary description will therefore be made for use with horses for which the present invention will likely find its broadest application.

Figure 2:
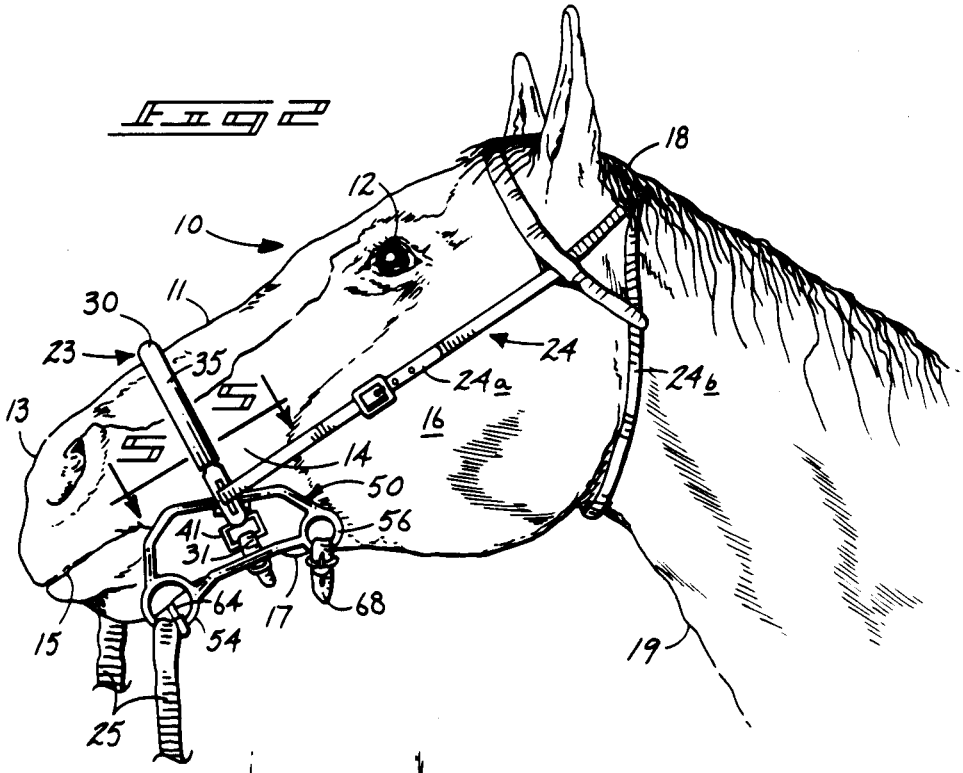
FIG. 2 is a view of the hackamore mounted to a horse's head.
Figure 3:
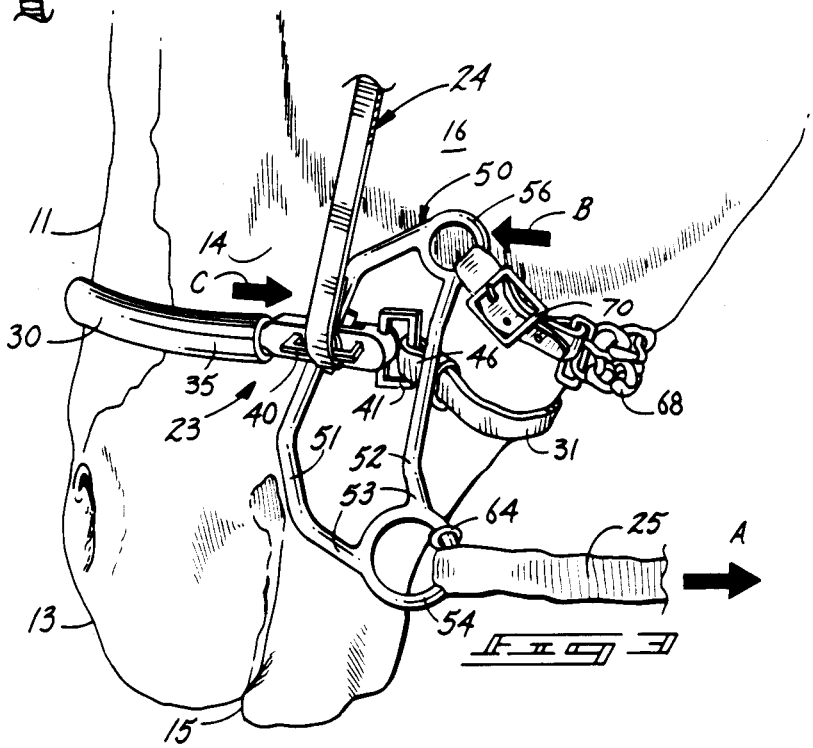
FIG. 3 is a view illustrating the present mechanical hackamore in its stopping function.
Figure 4:
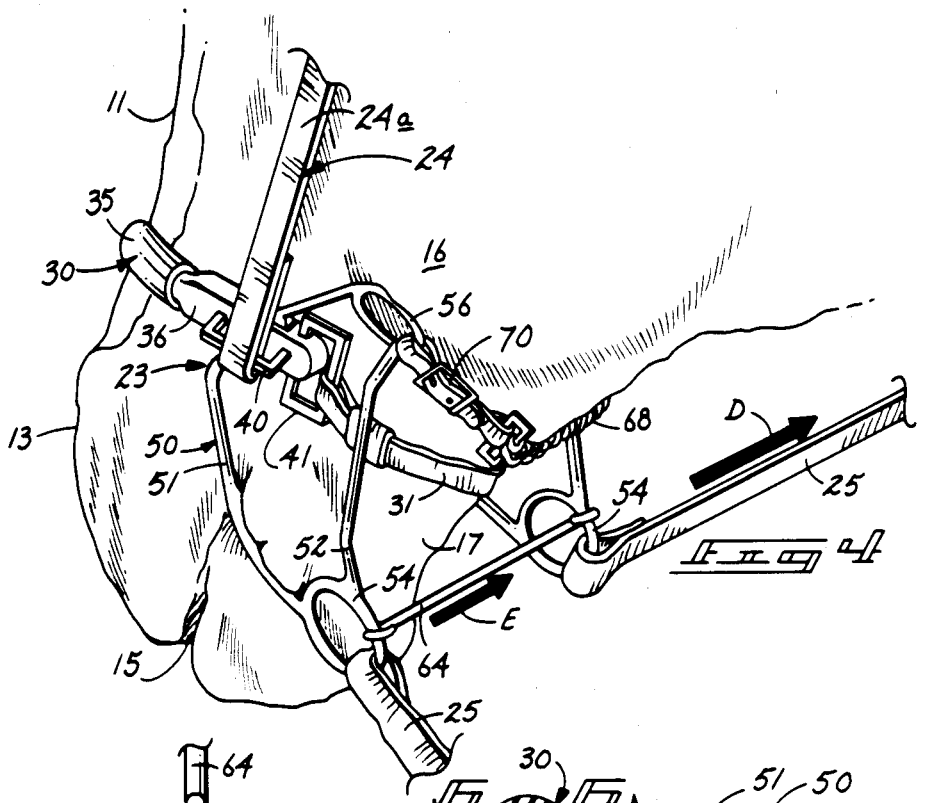
FIG. 4 is a view illustrating the present mechanical hackamore in its turning function.
Figure 5:
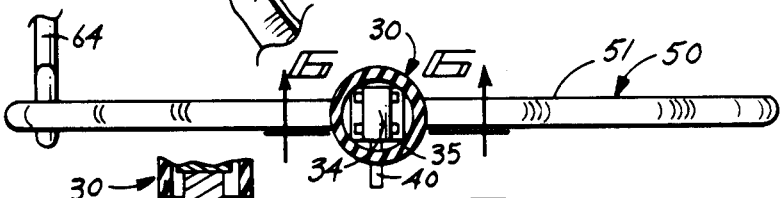
FIG. 5 is a section view taken substantially along line 5—5 in FIG. 1.

A horse's head is shown in FIG. 2 with portions of the horse's muzzle being shown in FIGS. 3 and 4. For purposes of this description, the horse's head is generally indicated by the reference numeral 10. The nose bridge is shown at 11, extending along the approximate top surface of the muzzle between the eyes 12 and nose 13. Cheeks 14 are situated on opposite sides of the nose bridge 11 and span areas on sides of the muzzle between the mouth 15 and the masseteric region 16. The underside of the muzzle includes a chin groove area 17 which is substantially vertically opposite to the bridge 11 of the nose. The top of the horse's head immediately rearward of the ears is considered the poll region 18 and is directly adjacent the neck 19.

A preferred form of the present mechanical hackamore is shown at 23 in FIG. 2 mounted to the horse's head briefly described above. The exemplified hackamore 23 is shown secured to the horse's head by a standard bridle 24. This form of bridle 24 includes a typical cheek strap 24*a* and throatlatch 24*b* which is utilized to hold the present hackamore in place on the horse's head. Details of the bridle, since they are common, will therefore not be further described in this application. Reins are shown at 25 connected to the present hackamore. Reins 25 are also conventional and need not be described in great detail herein.

The exemplified hackamore 23 includes a nose band 30 and a stabilizer strap 31 which, together, form a loop encircling the muzzle. The nose band 30 is adapted to extend transversely over the bridge 11 of the nose to ends situated adjacent opposite cheeks 14. The stabilizer strap 31 is adapted to extend from the nose band ends under the chin groove area 17.

The nose band 30 may be formed by a length of roller chain 34 (partially shown in FIG. 1) which is covered by a soft resilient sheath 35. The sheath may be formed of a soft rubber such as surgical tubing or other material that will conform with the chain to the contours across the nose bridge and cheeks and will not chafe against the nose bridge 11 and adjacent cheek areas. The inherent unilateral flexible nature of the roller chains will prevent flexion along the length of the muzzle so the band will remain in its substantially transverse orientation with respect to the horse's head.

Figure 1:
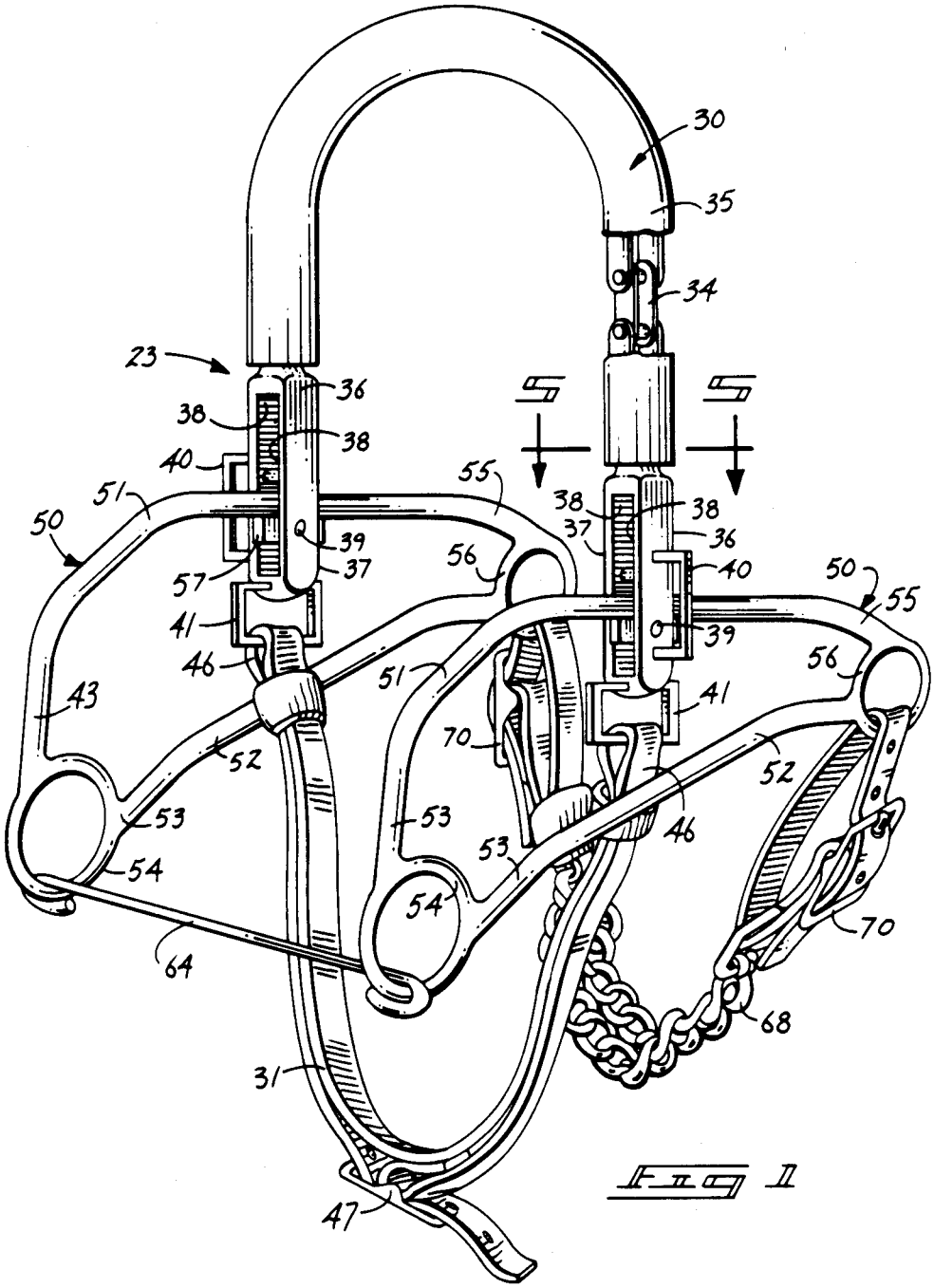
FIG. 1 is a partially fragmented pictorial view of the present hackamore.
Figure 6:
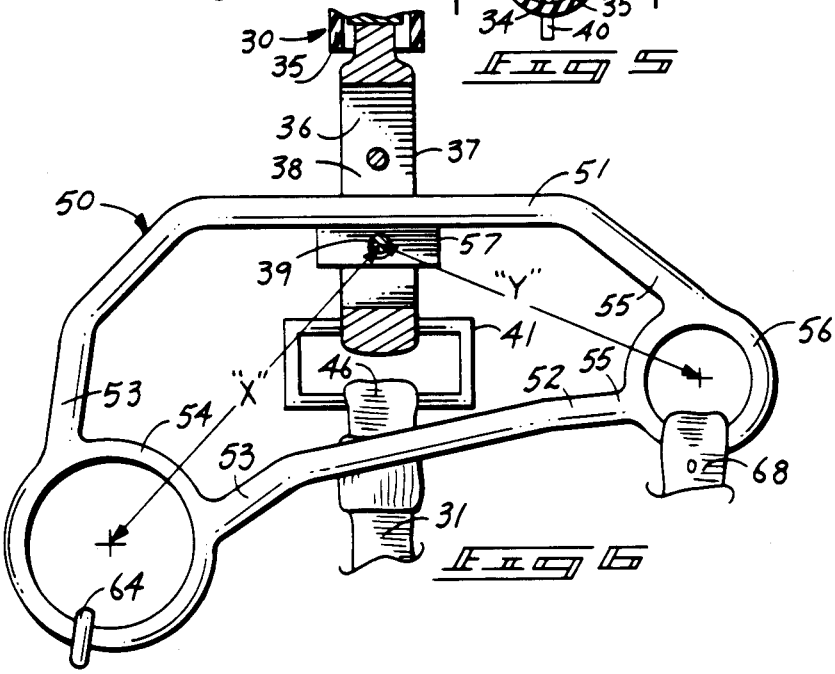
FIG. 6 is a sectional view taken substantially along line 6—6 in FIG. 5.

Ends of the nose band 30 are indicated at 36 and are shown in substantial detail by FIGS. 1 and 6. The ends 36 may be made up of rigid metal clevises 37, each having facing clevis surfaces 38. Pivot pins 39 extend between the two surfaces 38 of each clevis.

Each of the clevises 37 may also include a bridle mount 40 and a stabilizer strap mount 41. The bridle mount is adapted to receive ends of the bridle 24. The stabilizer strap mounts 41 may extend from bottom surfaces of the respective clevises to mount opposite ends of a stabilizer strap 31.

The stabilizer strap 31 may be formed of leather having loops 46 at opposed ends receiving the stabilizer strap mounts 41. The strap may be adjustable as shown in FIG. 1 by means of a standard buckle 47. The buckle 47 functions as means for adjusting the length of the stabilizer strap and therefore allows adjustment of the overall size of the loop formed by the strap 31 and nose band 30 to adapt the present hackamore to horses having varying size muzzles.

The pivot pins 39 mount a pair of opposed leverage frame means 50 which significantly differentiate the present mechanical hackamore from other existing forms of standard mechanical hackamores. The present leverage frame means 50 is constructed to span a relatively large cheek surface area of the horse. To this end, each leverage frame means 50 is comprised of an upper bar 51 and a lower bar 52. The two bars 51, 52 are elongated, are spaced apart from one another, and lie in a common plane. The planes are substantially parallel and vertical when the hackamore is mounted, so the frames will be oriented flush with the plane surfaces of the cheek areas 14.

The elongated bars 51 and 52 terminate in forward ends 53 which may be welded or otherwise secured to rein mounting rings 54. The rings 54 function as means for mounting the reins 25. Rearward ends 55 of the bars 51, 52 terminate at curb strap mounting rings 56. Rings 54, 56 may be welded or otherwise affixed to the bars 51, 52.

Each of the leverage frame means 50 preferably includes a plate 57 (FIG. 6) mounted on its upper bar 51. The plate 57 is slidably received between the facing clevis surfaces 38. Pivot pin 39 is received through the plate 57, thereby pivotably mounting the adjacent leverage frame to the adjacent end 36 of the nose band 30.

The plate 57 is of sufficient width to slidably engage flush against the facing surfaces 38, and will thereby prevent the leverage frame means from pivoting or tilting out of a plane that is coincidental or parallel to the plane of the frame and that is substantially perpendicular to the axis of the pivot pin 39. The pivot pins 39 are oriented by the nose band to be substantially normal or perpendicular to the adjacent cheek surfaces 14. The leverage frames 50 will therefore pivot only in planes substantially parallel to the plane of the adjacent cheek surfaces 14, and will not bind or gouge against the adjacent tissues when in use.

The pivot pin connection between the clevises 37 and the leverage frames 50 allows relatively free pivotal motion of the frames about the axes of the pivot pins 39. These axes typically become substantially coaxial with one another when the hackamore is mounted as shown in FIG. 2. So, for purposes of this description, an assumption will be made that the hackamore is in the orientation substantially as shown in FIG. 2 with the pivot pins 39 being substantially coaxial.

It is important to note the geometry of the leverage frames in relation to their respective pivot axes. The rein mounting rings 54 are spaced by a distance "X" (FIG. 6) from the pivot axis that is preferably less than twice the distance "Y" between the pivot axis and the curb strap mounting rings 56 along the plane of the leverage frame. This relationship produces a definite yet humane mechanical advantage when stopping forces are applied through the rein mounting rings 54. The leverage factor utilized by my hackamore is a definite advantage over prior mechanical hackamores that utilize extreme amounts of leverage, even to the extent where a pull on the reins may be so amplified by the hackamore levers that the horses's mouth and nasal passages are clamped shut.

A forward stabilizer means 64 is provided between the pair of leverage frame members adjacent the forward frame ends. The forward stabilizer means 64 is provided to transmit lateral forces supplied through the reins 25 to the frame means 50 on opposite sides of the horse's face. The stabilizer means 64 is preferably comprised of a relatively rigid bar attached at its ends to the rein mounting rings 54. Stabilizer means 64, coupled with the configuration of the lever frames, provides greatly improved turning control over previously known hackamores. This advantage will be discussed further as operation of the present invention is described below.

The rearward rings 56 of the leverage frame means are connected by a curb strap which is generally shown at 68. It is advantageous that the curb strap 68 be removable, as by use of buckles 70, to facilitate substitution by other curb straps having varying widths. Wider curb straps will provide the extra advantage of gentler control while narrower straps will provide more firm, effective control.

The curb strap 68 is intended to pass under the chin area 17 rearward of the stabilizer strap 31. Placement of the curb strap is appropriately indicated in FIGS. 2 and 3. It will be levered upwardly by the frames 50 responsive to pulling forces applied to the reins 25 to firmly, yet gently, engage the chin area of the muzzle slightly forward of the masseteric regions 16 to signal the rider's desire to slow or stop. This action is initiated by pulling rearwardly on the reins 25 (see arrow A in FIG. 3.) The rearward force applied by the reins 25 causes pivotal motion of the leverage frames 50 such that the rein mounting rings 54 swing rearwardly and the curb strap mounting rings (and curb strap 68) swing upwardly (see arrow B in FIG. 3). The nose band is also pulled downwardly by this action (see arrow C in FIG. 3). The loop formed by the nose band and curb strap is effectively reduced by this action. The mechanical advantage afforded through the geometry of the leverage frames 50 as indicated above allows the rider to produce very effective stopping or slowing control by the tightening muzzle grip afforded through the nose band and curb strap. It is emphasized that the control is accomplished humanely, without producing the severe clamping effect as noted with a number of known, standard hackamores.

In fact, some prior mechanical hackamores as indicated above were intentionally designed to produce a substantially crushing effect about the muzzle area of the horse, tending to cut off free air passageway through the mouth and nostrils. I have found such apparatus not only inhumane but, if used, will not result in a properly trained animal. Instead, I have found that my hackamore, with the described leverage frames, nose band and curb strap mounted substantially in the position shown in FIG. 2, will function admirably for control and training purposes without closing off air passageways when used with stopping or slowing rein action. The mild leverage of the frame members and placement of the nose band and curb strap have been found to be extremely effective to produce immediate stopping or slowing response without hurting or panicking the horse.

OPERATION

Prior to operation, the present mechanical hackamore is first attached to a standard bridle 24 substantially as shown in FIG. 2. This is done simply by attaching the cheek straps of the bridle to the bridle mounts 40 provided on the clevises 37. The entire assembly may then be secured to the horse's head and face as shown in FIG. 2. Adjustments may be made at this point to insure placement of the nose band 30 at an area of the nose bridge 11 sufficiently rearward of the nostrils to avoid closing of the air passages when stopping forces are applied. A location of the nose band substantially midway between the nostrils and forward masseteric areas 16 has been found effective. This position may be established through adjustment of the bridle.

The next adjustment may be to selectively secure the forward stabilizer strap 31 so the loop formed by the stabilizer strap 31 and the nose band 30 will embrace the muzzle loosely, yet without the stabilizer strap hanging free. The stabilizer strap 31 thereby becomes effective in controlling the position of the nose band 30 and the clevises 37 adjacent the cheek areas 14.

A third adjustment may be to select an appropriate length for the curb strap 68. The length should be such that the curb strap will just touch the underside of the chin when the reins are slack. This is also a good time to determine the need for different width curb straps. If the horse is relatively untrained, a narrow curb strap may be utilized to facilitate a firmer control. More experienced, trained horses will likely not require the use of firmer control and will readily respond to wider curb straps. Adjustments may be made by substituting various width straps throughout training procedures.

After installation of the present mechanical hackamore, control of the horse may be maintained in the usual manner. Stopping forces are applied by pulling rearwardly on the reins. This action results in leveraged motion of the leverage frames 50, pulling the nose band downwardly (see arrow C, FIG. 3) by the pivot pins 50 and pulling the curb strap 68 upwardly (see arrow B, FIG. 3) by the curb strap mounting rings 56. The gentler leverage factor and placement of the nose band and curb strap affords a gentle, yet firm, gripping about the muzzle, therefore encouraging the horse to slow or stop.

Turning motions are accomplished by a lateral pull on the rein 25 (see arrow D, FIG. 4) in the direction of the desired turn. In other words, a right turn would entail a pull on the right rein in the right hand direction. This lateral pull is transmitted directly through from the leverage frame on the right side of the horse's face to the leverage frame on the left side of the horse's face through provision of the rigid stabilizer bar 64 (see arrow E in FIG. 4). The pulling action of the rein is therefore transmitted directly to the leverage frame on the opposite or left cheek of the horse, pressing that frame against the left cheek of the horse in the direction of turn. The horse will naturally turn its head away from the pressure created by the frame pressing against that cheek surface. It is important to note that the pressure created by the leverage frame is spread over a substantial surface area of the cheek due to the configuration of the leverage frame. Thus, a gentle, surface pressure is created tending to effect a turn of the head which is followed by a turn of the body. A left hand turn is accomplished simply by pulling laterally on the left rein.

The above and other control capabilities are all accomplished through the present mechanical hackamore without the need for a bit in the horse's mouth. Absence of the bit, plus the above indicated humane and gentle guidance features, results in a device that is extremely effective and practical for training, general riding, and a wide variety of competitive uses.

In compliance with the statute, the invention has been described in language more or less specific as to structural features. It is to be understood, however, that the invention is not limited to the specific features shown, since the means and construction herein disclosed comprise a preferred form of putting the invention into effect. The invention is, therefore, claimed in any of its forms of modifications within the proper scope of the appended claims, appropriately interpreted in accordance with the doctrine of equivalents.

I claim:

1. A mechanical hackamore adapted to fit over the muzzle of an animal such as a horse, comprising:

a nose band extending between ends and adapted to be received over a horse's nose bridge with the nose band ends being situated adjacent the cheek regions on opposite sides of the nose bridge;

a stabilizer strap operably connected to the nose band and adapted to be received under the chin region of the horse's head, thereby forming a loop with the nose band for transversely encircling the nose bridge, cheek and chin area of the horse;

a pair of leverage frame means mounted at pivots situated adjacent the ends of the nose band for pivotal movement in relation to the nose band and stabilizer strap and for substantially flush engagement with cheek surfaces on opposite sides of the horse's face;

wherein each leverage frame means includes a pair of elongated rods that extend forwardly of the pivot to forward frame ends joined to a rein mount and rearwardly of the pivot to a curb strap mount at rearward rod ends;

a curb strap extending between the curb strap mounts, and adapted to be received under the horse's chin for movement toward and away from the horse's chin responsive to pivotal movement of the frame means; and forward stabilizer means extending between the pair of leverage frame means adjacent the forward frame ends for transmitting lateral forces applied through reins to the leverage frame means on opposite sides of the horse's face so that one of the frame means will press against a side of the horse's face in the direction of a desired turn.

2. The mechanical hackamore of claim 1 further comprising adjustment means along the stabilizer strap facilitating length adjustment of the stabilizer strap.

3. The mechanical hackamore of claim 1 further comprising clevis means at the ends of the nose band for securing the leverage frame means for pivotal movement about substantially coaxial axes that are laterally oriented relative to the horse's face so the frame means will move pivotally in planes substantially parallel to the adjacent surfaces of the horse's face.

4. The mechanical hackamore of claim 1 wherein the curb strap is removably mounted to the curb strap mounts.

5. The mechanical hackamore of claim 1 wherein the forward stabilizer means is comprised of a rigid stabilizer bar mounted between the forward frame ends.

6. The mechanical hackamore of claim 1 wherein the pivot for each leverage frame means is situated along one of the elongated rods between the rein mount and the curb strap mount.

7. The mechanical hackamore of claim 1 wherein the distance on each leverage frame means between the pivot and the rein mount is less than twice the distance between the pivot and the curb strap mount.

8. The mechanical hackamore of claim 1 further comprising bridle mounting means operatively connected to the nose band ends for mounting a bridle to the mechanical hackamore.

9. The mechanical hackamore of claim 1 wherein the nose band is comprised of a length of roller chain covered by a soft resilient sheath.

10. A mechanical hackamore adapted to fit over the muzzle of an animal such as a horse, comprising:

a nose band extending between ends and adapted to be received over a horse's nose bridge with the nose band ends being situated adjacent the cheek regions on opposite sides of the nose bridge;

a stabilizer strap operably connected to the nose band and adapted to be received under the chin region of the horse's head, thereby forming a loop with the nose band for transversely encircling the nose bridge, cheek and chin area of the horse;

a pair of elongated leverage frame means each forming an open framework with spaced bottom and top members extending between frame ends and mounted at pivots situated adjacent the ends of the nose band for pivotal movement in relation to the nose band and stabilizer strap and for substantially flush engagement with cheek surfaces on opposite sides of the horse's face;

wherein the leverage frame means extend from the pivots forwardly to forward frame ends adapted to mount reins, and rearwardly from the pivots to rearward frame ends;

wherein the pivots are situated substantially midway along the lengths of the frame means between the forward and rearward frame ends;

curb strap mounting means on each leverage frame means adjacent the rearward frame end thereof;

a curb strap extending between the curb strap mounting means of the leverage frame means, and adapted to be received under the horse's chin for movement toward and away from the horse's chin responsive to pivotal movement of the frame means; and forward stabilizer means extending between the pair of leverage frame means adjacent the forward frame ends for transmitting lateral forces applied through reins to the leverage frame means on opposite sides of the horse's face so that one of the frame means will press against a side of the horse's face in the direction of a desired turn.

* * * * *